US007370443B2

(12) United States Patent
Gibert et al.

(10) Patent No.: US 7,370,443 B2
(45) Date of Patent: May 13, 2008

(54) FOOTWEAR ITEM FOR RACKET SPORTS

(75) Inventors: Xavier Gibert, Chassieu (FR); Francis Lepage, Dommartin (FR); Bertrand Barre, Lapeyrouse (FR)

(73) Assignee: Babolat VS, Lyons (FR)

( * ) Notice: Subject to any disclaimer, the term of this patent is extended or adjusted under 35 U.S.C. 154(b) by 58 days.

(21) Appl. No.: 10/526,399

(22) PCT Filed: Sep. 9, 2003

(86) PCT No.: PCT/FR03/02679

§ 371 (c)(1),
(2), (4) Date: Sep. 21, 2005

(87) PCT Pub. No.: WO2004/021818

PCT Pub. Date: Mar. 18, 2004

(65) Prior Publication Data

US 2006/0137219 A1 Jun. 29, 2006

(30) Foreign Application Priority Data

Sep. 9, 2002 (FR) ..... 02 11134

(51) Int. Cl.
*A43B 13/14* (2006.01)

(52) U.S. Cl. ..... 36/103; 36/107; 36/108; 36/30 R; 36/76 R

(58) Field of Classification Search ..... 36/103, 36/107, 108, 27, 28, 30 R, 76 R
See application file for complete search history.

(56) References Cited

U.S. PATENT DOCUMENTS

| | | | | |
|---|---|---|---|---|
| 4,858,338 | A | 8/1989 | Schmid | |
| 5,572,805 | A | 11/1996 | Giese et al. | |
| 5,845,420 | A * | 12/1998 | Buccianti et al. | 36/91 |

FOREIGN PATENT DOCUMENTS

| | | | |
|---|---|---|---|
| EP | 0 516 874 | A1 | 12/1992 |
| GB | 2 256 784 | A | 12/1992 |
| WO | WO 00 72713 | A1 | 7/2000 |

* cited by examiner

*Primary Examiner*—Ted Kavanaugh
(74) *Attorney, Agent, or Firm*—Dowell & Dowell PC

(57) ABSTRACT

The invention relates to a footwear item that is designed for racket sports. The inventive item includes a sole that includes a dynamic element that stores and releases energy when the sole is subjected to lateral stresses. The dynamic element includes at least two pair of elastically deformable support parts which are located longitudinally on either side of the metatarsus support area of the sole and which extend opposite to one another such that a first pair extend on opposite sides of a longitudinal axis of the sole and toward an arch portion of the sole and the second pair extend on opposite sides of the longitudinal axis of the sole and toward a front part of the sole.

13 Claims, 3 Drawing Sheets

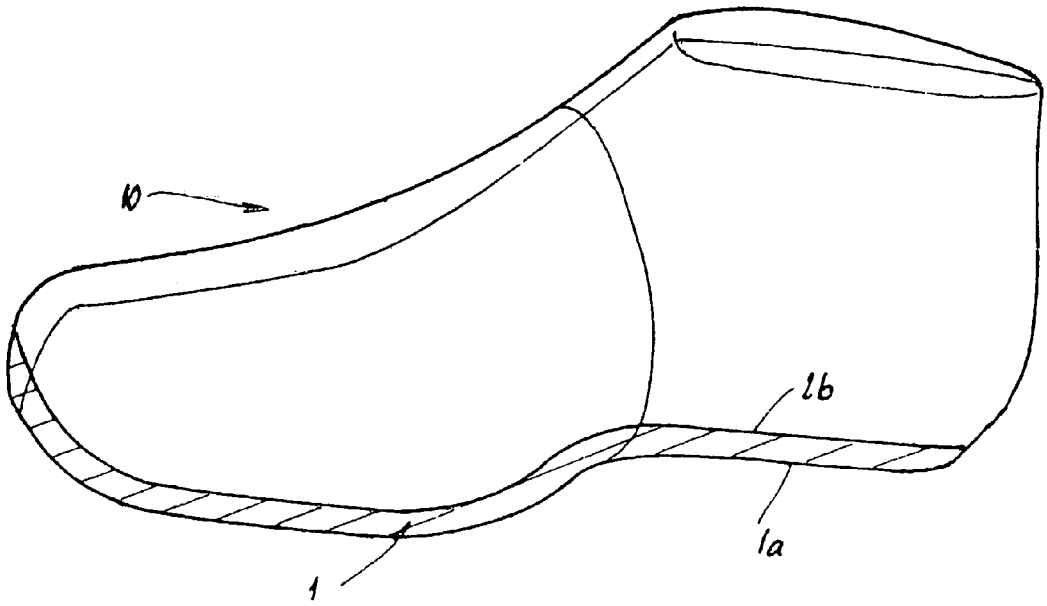
FIG 1
FIG 8
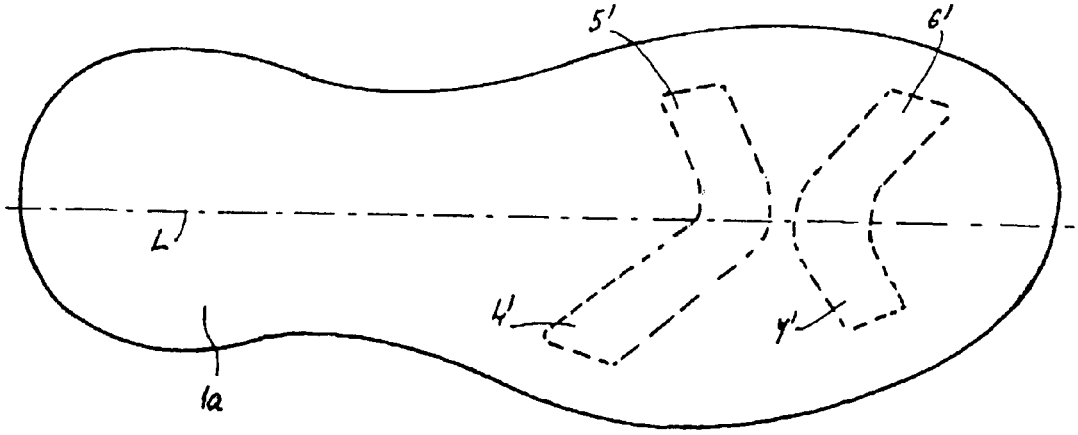

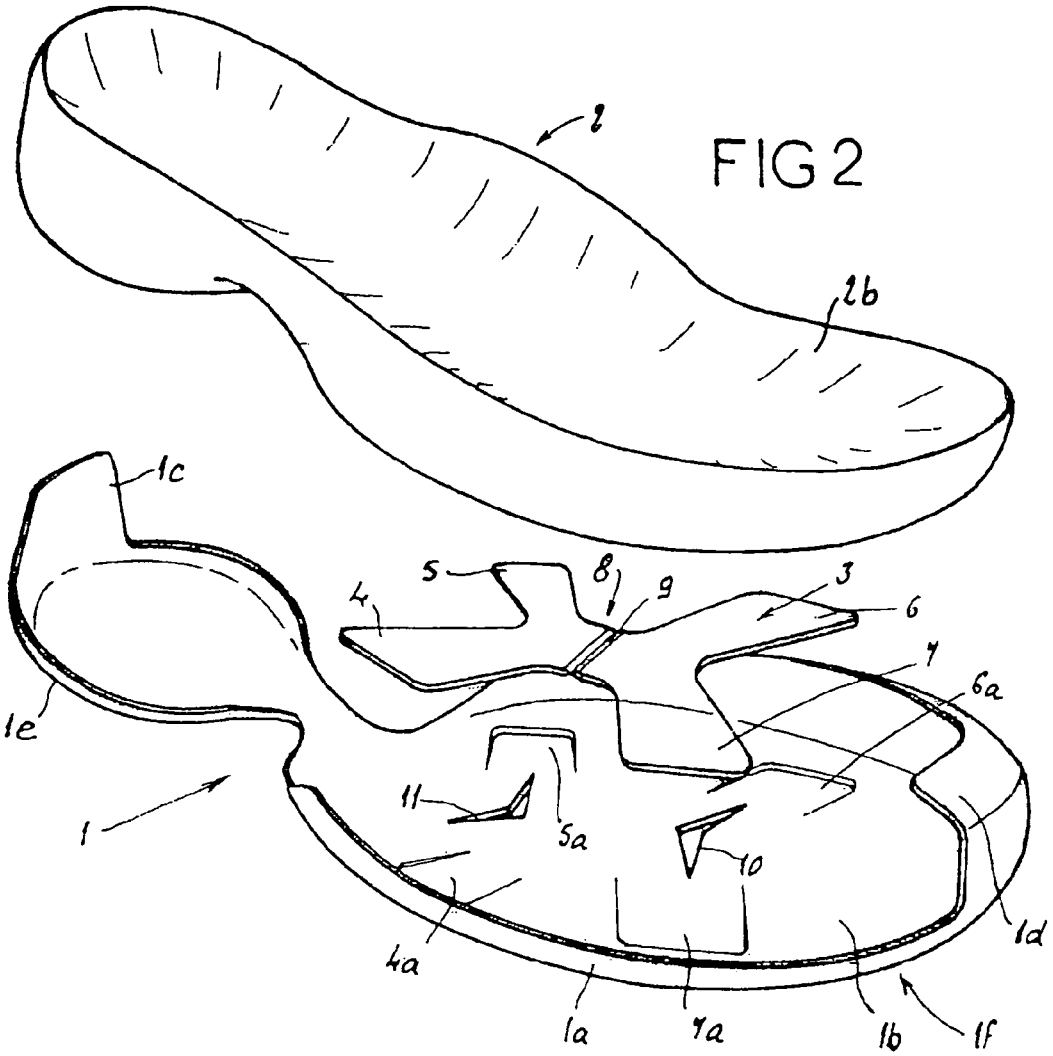
FIG 2
FIG 3
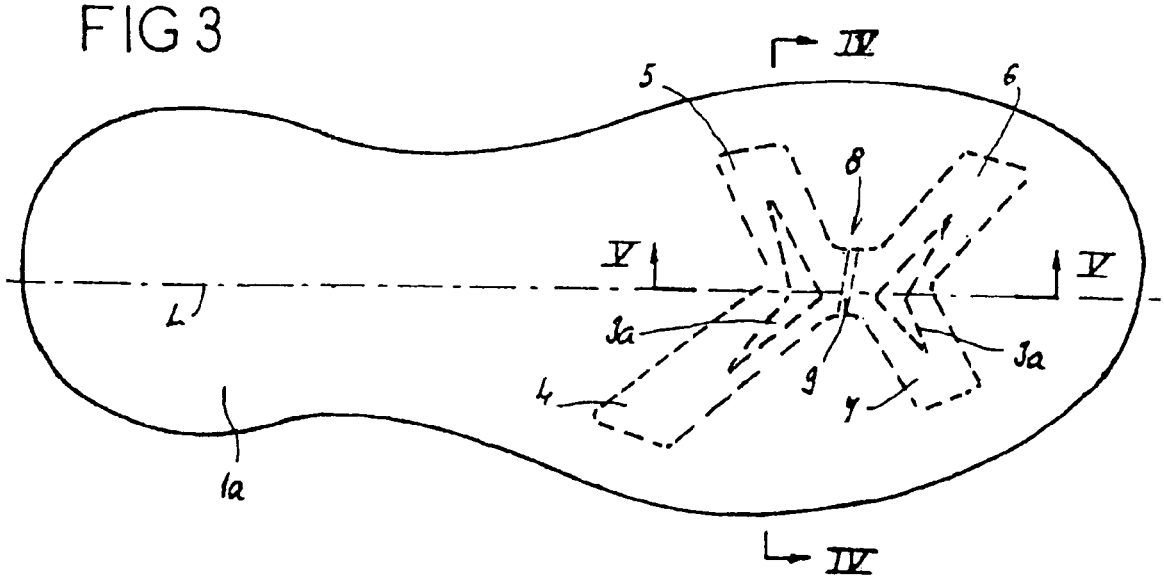

FOOTWEAR ITEM FOR RACKET SPORTS

BACKGROUND OF THE INVENTION

1. Field of the Invention

The present invention relates to the technical domain of shoes, and more particularly to the domain of footwear items for racket sports.

2. Description of the Related Art

Such shoes are subjected to considerable mechanical stresses, particularly when tennis, badminton, squash or the like are played.

The present invention relates more particularly to a sole intended for such shoes, as it is that which takes up extreme efforts and stresses, while ensuring optimum comfort for the wearers of such shoes.

It is known to produce soles for shoes, for example for sports shoes comprising a sole whose outer face is intended to come into contact with the ground and whose inner face is intended to come into contact with a user's foot.

Shoes are also known, equipped with such a sole which further houses an elastically deformable, dynamic element.

Document EP 0 516 874 describes a shoe of which the front part of the sole is provided with an insert, of the Belleville washer type, making it possible to store and release energy, during walking.

Such a sole is in no way adapted for sports of the tennis or squash type, in which the stresses of the sole and the shoe are extremely more intense and distributed differently than in a conventional walking shoe, such as the one described in that document.

SUMMARY OF THE INVENTION

The purpose of the present invention is to produce a sole for shoe intended for extreme uses, in which the lateral supports of said sole are considerably under stress, and this so as to assist the return of the sole and the foot in a substantially normal or antagonistic position in which the lateral supports are under less stress.

According to the invention, the footwear item of the aforementioned type is essentially characterized in that the sole comprises a dynamic element intended to store and release energy when said sole is subjected to lateral stresses, comprising, on the one hand, a return plate positioned in the sole so as to extend at least partially beneath a zone corresponding to the arch of the foot and at least partially beneath a zone corresponding to the front part of the foot and, on the other hand, at least two elastically deformable lateral ground-support parts which are located longitudinally on either side of a support zone of the metatarsus.

In accordance with a form of embodiment of the sole according to the invention, the return plate comprises four branches defining for example the form of an X, each of the branches bearing on a support element.

In a variant, the four branches are connected together.

In yet another variant, the four branches are connected in twos to constitute two independent pairs.

The support elements are preferably located above the return plate.

In a variant, the support elements are located below the return plate.

The support elements are preferably located on and in the vicinity of the periphery of an inner face of an outer layer of the sole, so as to define four ground-support zones on the inner face.

According to a form of embodiment, each support element is an added compressible part.

According to a form of embodiment, the plate presents a central part extending longitudinally with respect to a longitudinal axis (L) of the sole, the branches extending obliquely towards the support elements from said central part.

According to a form of embodiment, the central part presents a transverse groove, located in said sole at the level of the zone corresponding to the positioning of the metatarsus thus allowing an elastic deformation of the plate along an axis substantially normal with respect to the longitudinal axis.

According to a form of embodiment, the plate presents excess thicknesses at least locally.

The excess thicknesses are for example made of elastic material and are locally thinned.

According to a form of embodiment, the lateral supports constitute supports antagonistic in twos.

According to a form of embodiment, the dynamic element is a return plate with memory of shape.

According to a form of embodiment, the plate is fixed by adhesion on the inner face of the outer layer.

According to a form of embodiment, the return plate is located between the outer layer and an intermediate layer which are disconnected at least locally.

The branches of the return plate are for example integral with one another.

In a variant, the return plate comprises at least two V-shaped pieces mounted in opposition.

An advantage of the shoe according to the invention lies in a mechanical assistance to the reactivity of the fore-foot.

The shoe according to the present invention thus allows a lateral dynamic assistance to the reactivity of the fore-foot, by promoting an easier and quicker return during the support phases. In effect, the dynamic element makes it possible to cause the ground-support parts to react, at the level of the fore-foot, in opposition. On either side of the support zone of the metatarsus, the support parts are thus compressed for one, relaxed for the other.

Another object of the present invention is to provide a shoe comprising a sole having one of the aforementioned characteristics.

BRIEF DESCRIPTION OF THE DRAWINGS

Other characteristics and advantages will also be apparent from the detailed description given hereinafter, with reference to the accompanying drawings by way of illustrative example, in which:

FIG. 1 is a view in perspective of a shoe or footwear item for racket sport provided with a sole according to the present invention.

FIG. 2 is an exploded view of a form of embodiment of a sole according to the invention.

FIG. 3 is a view of the sole of FIG. 2 from underneath.

FIG. 8 is a view of a variant of the sole according to the present invention, from underneath.

DESCRIPTION OF THE PREFERRED EMBODIMENTS

Figure 4:
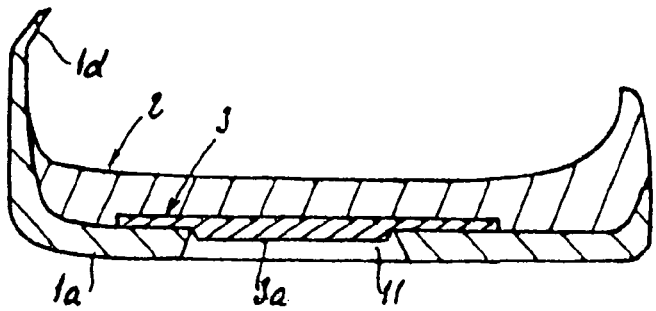
FIG. 4 is a section along line IV IV in FIG. 3.

The shoe 10 or footwear item for racket sports according to the invention shown in perspective in FIG. 1 is a shoe more particularly intended to be used when practicing sports such as tennis, squash or badminton, i.e. sports for which the player uses a racket.

When practicing such sports, the player frequently has to balance his/her body in lateral movements from left to right and vice versa. The lateral to and fro movements are very numerous during the game and must be rapid.

The shoe 10 integrates a sole as shown in FIG. 2 and which comprises for example an outer layer 1. The latter comprises an outer face 1*a* intended to come into contact with the ground and an inner face 1*b*. The outer face 1*a* may be covered with different coatings capable of improving its ground adherence.

The sole of FIG. 1 also comprises an intermediate layer 2 intended to be positioned on the outer layer 1 and on which is positioned a complementary, so-called hygienic sole (not shown). This intermediate layer presents an inner face 2*b* intended to come into contact with the user's foot. The outer layer 1 may also be provided locally with rising edges 1*c*, 1*d* between which the intermediate layer 2 is positioned.

According to an essential characteristic of the present invention, the dynamic element takes the form of a return plate 3 positioned in the sole, at a level which is a function of the internal structure of the sole. The function of this plate is independent of the number of strata entering in the composition of the sole, all that is important being the fact that the player can bear on this plate during his/her game, and in particular during the lateral return movements.

Between the outer layer 1 and the intermediate layer 2 there is positioned for example the return plate 3 forming a dynamic element of the sole. Such a dynamic element makes it possible to store and release energy resulting from considerable mechanical bearings and stresses of the shoe and consequently of the sole.

The return plate 3 is for example fixed on the inner face 1*b* by adhesion.

The intermediate layer 2 is added on the outer layer 1, and more particularly fixed on the inner face 1*a* of the latter, so as to produce the sole according to the invention.

The outer layer 1 and the intermediate layer 2 are disconnected at least locally, particularly in the vicinity of the return plate 3. The intermediate layer 2 is fixed on the outer layer 1 at the level of a part 1*e* forming the heel of the sole and at the level of the periphery or of the rising edges 1*c*, 1*d* of a front part 1*f*.

The return plate 3, shown in particular in FIGS. 2 and 3, comprises four branches 4, 5, 6 and 7 connected together and defining for example an X-shape.

Each of the branches 4, 5, 6 and 7 bears on a corresponding support element 4*a*, 5*a*, 6*a* and 7*a* located on and in the vicinity of the periphery of the inner face 1*b*.

The support elements 4*a*, 5*a*, 6*a* and 7*a* thus define four lateral ground-support zones, on the inner face 1*b*.

Figure 5:
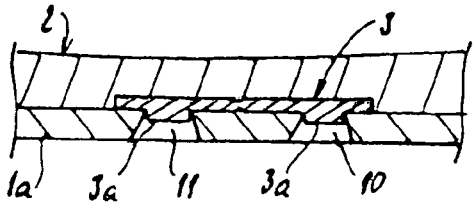
FIG. 5 is a section along line V V in FIG. 3.
Figure 6:
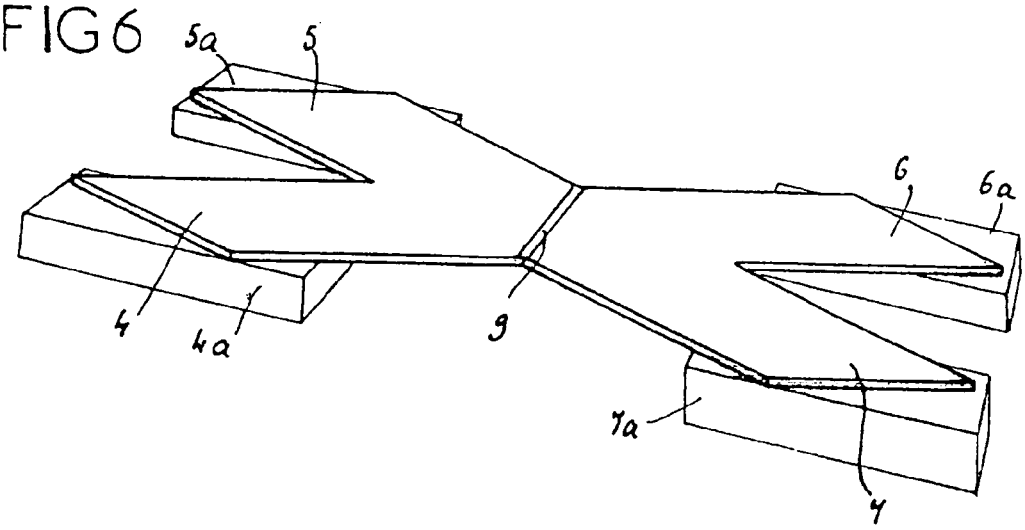
FIGS. 6 and 7 schematically show an example of functioning of a dynamic element of a sole according to the invention.

Each support element 4*a*, 5*a*, 6*a* and 7*a* is for example constituted by a compressible piece added on the inner face 1*b* (cf. FIGS. 5 and 6).

By way of variant, each of the support elements may be made by a slight deformation, excess thickness or removal of matter in the inner face 1*b*, serving to position the ends of the respective branches 4, 5, 6 and 7.

In addition, in a variant, the support elements 4*a* to 7*a* may not be located below the branches, but be located above the branches of the plate.

The return plate 3 preferably presents a central part 8 extending longitudinally with respect to a longitudinal axis L of the sole.

The branches 4, 5, 6 and 7 extend obliquely towards the corresponding support elements 4*a*, 5*a*, 6*a* and 7*a*, from said central part 8.

According to the invention, the branches 4 to 7 extend on either side of the longitudinal axis defined by the zone of support of the metatarsus so that the support elements are located on either side of this axis. Two pairs of support elements are thus defined, one constituted by the support elements 4*a* and 5*a*, and the other by the support elements 6*a* and 7*a*. Within each of these pairs, the support elements interact in opposition to allow the lateral return of the foot.

In this way, when the support element 4*a* is compressed, the opposite support element 5*a* is relaxed, and vice versa. The same applies for the pair of support elements 6*a* and 7*a*.

The central part 8 also presents a transverse groove 9, extending in the sole, following a zone corresponding to the positioning of the metatarsus, when the return plate 3 is fixed on the inner face 1*b*.

This groove 9 thus allows an elastic deformation of the return plate 3, along an axis substantially normal with respect to the longitudinal axis L and merged with the groove 9.

According to a form of embodiment, the return plate 3 also presents excess thicknesses 3*a*.

A form of embodiment of these excess thicknesses 3*a* is shown for example in FIGS. 2, 3 and 4.

The excess thicknesses 3*a* are made of a material whose elasticity allows a deformation during compression of one or more of the branches 4 to 7, and promotes the return into initial position. The excess thicknesses are for example thinned in the central part or curved in order to promote the function of compression/relax of the return plate.

This function of compression/relax may further be promoted by multiplying the lateral support points, for example by increasing the number of branches of the return plate. This makes it possible to obtain a more and more local reaction to the stresses, and even a certain progressivity in this reaction. This function may also be obtained by arranging recesses in the return plate.

The outer layer 1 is for example provided with openings 10 and 11, in which the excess thicknesses 3*a* are engaged and positioned.

The openings 10 and 11 may advantageously be coated or filled with a transparent material, making it possible to visualize through the outer layer 1 at least a part of the return plate 3.

Similarly, the outer layer 1 may also be provided with complementary transparent zones, opposite the support elements 4*a*, 5*a*, 6*a* and 7*a* or the ends of the branches 4, 5, 6, 7, so as to visualize via the outer face 1*a* the zones corresponding to the lateral supports.

The return plate 3 is for example metallic or made from a high-performance plastics material, or from composite materials.

The intermediate layer 2, as well as the outer layer 1, are for example made of rubber.

According to a variant (not shown), the intermediate layer 2 may be provided with slots located opposite the branches 4, 5, 6, 7, in which are positioned inserts made of highly deformable, elastic materials (for example of elastomer, polyurethane, . . . type).

Such inserts, with their elastic properties, allow the return of the fore-foot to be improved.

The inserts of shape complementary to the slots preferably present shapes identical or similar to the shapes of the branches 4, 5, 6 and 7.

In yet another variant (not shown), the sole may be reduced to one single stratum, for example be constituted solely by the outer layer 1 and the return plate as well as the support elements are embedded in the latter.

Figure 7:
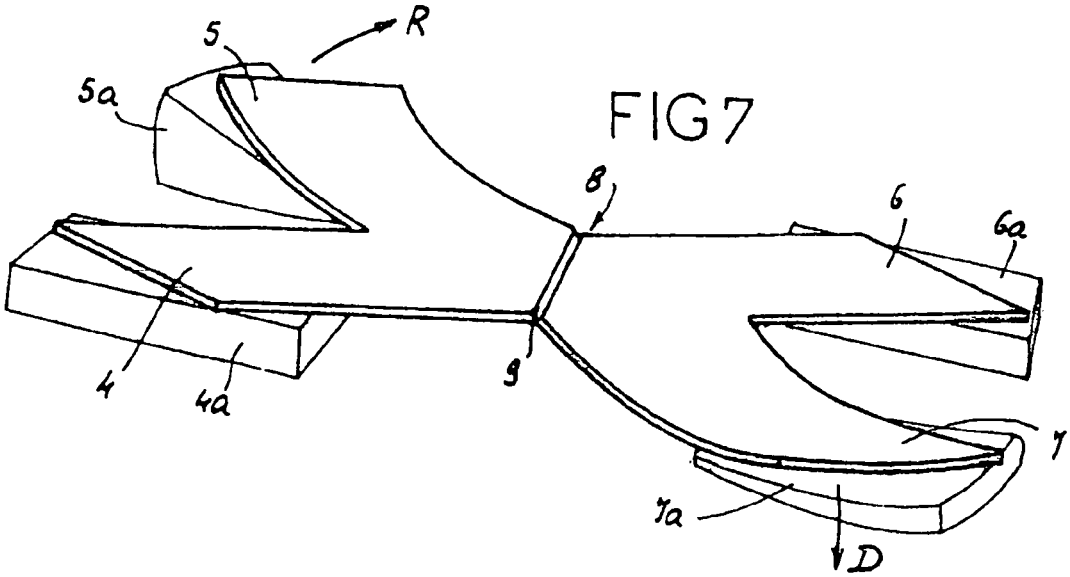

FIGS. 6 and 7 illustrate functioning of the return plate 3.

At rest, i.e. without stress on the sole, the return plate 3 extends in substantially planar manner as shown schematically in FIG. 6.

When the user bears forwardly and laterally with his fore-foot, shown for example in FIG. 7, the branch 7 is elastically deformed in the direction of arrow D and compresses the support element 7*a*.

Simultaneously, the branch 5 is elastically deformed in antagonistic manner in the direction of the arrow and relaxes the support element 5*a*. Similarly, the support element 6*a* opposite to support element 7*a* is relaxed.

The sole thus accompanies the movement of the foot, in particular when the latter exerts lateral bearings on the sole. In addition, the energy stored thanks to the stressing of the return plate 3 makes it possible to assist the foot for a return into another position or into a rest position as soon as the aforementioned lateral bearings cease.

Every lateral bearing exerted by the foot may thus have repercussions on one of the branches 4, 5, 6, 7 and may thus be assisted by the functioning of the return plate 3.

The branches 4 to 7 of the return plate 3 are for example integral with one another. In a variant, the return plate is obtained by fixing two V-shaped pieces, mounted in opposition, on each other.

In yet another variant as shown in FIG. 8, the two V-shaped pieces are independent of each other. Thus, the two branches 4' and 5', on the one hand, and the two branches 6' and 7', on the other hand, constitute two independent pairs mutually spaced apart in the fore-foot.

It goes without saying that the invention is not limited solely to the forms of embodiment described hereinabove by way of example. On the contrary, it covers all the variants. In particular, the aforementioned characteristics might be associated differently without departing for all that from the scope of the invention.

The invention claimed is:

1. A sports shoe comprising, a sole having a longitudinal axis (L), a dynamic element mounted within a metatarsus support area of the sole for storing and releasing energy caused by a person shifting laterally, the dynamic element including a support plate having at least a first pair of elastically deformable branch elements extending from a central portion of the support plate toward an arch portion of the sole with the branch elements extending on opposite sides of the longitudinal axis (L) and at least a second pair of elastically deformable branch elements extending from the central portion of the support plate, opposite the first pair, toward a front portion of the sole and so as to be on opposite sides of the longitudinal axis (L), and wherein the elastically deformable branch elements of each pair act in opposition with one another so as to store and release energy when the sole is subjected to lateral stresses.

2. The sports shoe according to claim 1, in which the dynamic element is located between an outer layer and an intermediate layer of the sole and wherein the intermediate layer is secured to the outer layer at a heel portion of the sole and at the front portion of the sole.

3. The sports shoe according to claim 2 wherein the branch elements together form of an X, and each of the branch elements bearing on a separate compressible support element on an upper face of the lower portion of the sole.

4. The sports shoe according to claim 3, wherein the central portion of the support plate includes a groove which extends between the two pairs of branch elements so as to be transversely oriented with respect to the longitudinal axis of the sole.

5. The sports shoe according to claim 4 wherein the two pairs of branch elements are elastically deformable relative to one another along the groove.

6. The sports shoe of claim 5 wherein the support plate includes zones of increased material thickness that extend from a lower surface thereof and along a portion of each of the branch elements, and openings in the sole in which the zones of increased thickness are cooperatively seated.

7. The sports shoe of claim 3 wherein the support elements are pieces that are added to the inner face of the sole.

8. The sports shoe according to claim 1 wherein the central portion of the support plate includes a groove which extends between the two pairs of branch elements so as to be transversely oriented with respect to the longitudinal axis of the sole.

9. The sports shoe according to claim 8 wherein the two pairs of branch elements are elastically deformable relative to one another along the groove.

10. The sports shoe according to claim 9 wherein the branch elements of the support plate extend diagonally outwardly relative to the longitudinal axis of the sole.

11. The sports shoe of claim 9 wherein the support plate includes zones of increased material thickness that extend from a lower surface thereof and along a portion of each of the branch elements, and openings in the sole in which the zones of increased thickness are cooperatively seated.

12. The sports shoe according to claim 1 wherein the branch elements of the support plate extend diagonally outwardly relative to the longitudinal axis of the sole.

13. The sports shoe of claim 12 wherein the support plate includes zones of increased material thickness that extend from a lower surface thereof and along a portion of each of the branch elements, and openings in the sole in which the zones of increased thickness are cooperatively seated.

* * * * *